United States Patent [19]

Hasegawa

[11] 4,231,487

[45] Nov. 4, 1980

[54] PULL TAB HAVING MEMORY FOR EFFECTING ROLLING UP OF TAB AND REMOVABLE PANEL PORTION

[75] Inventor: Gary K. Hasegawa, Chicago, Ill.

[73] Assignee: The Continental Group, Inc., New York, N.Y.

[21] Appl. No.: 66,596

[22] Filed: Aug. 14, 1979

[51] Int. Cl.[3] ..... B65D 41/32

[52] U.S. Cl. ..... 220/269; 220/260; 220/270

[58] Field of Search ..... 220/260, 265, 270, 269, 220/359; 229/7 R, 43; 222/541

[56] References Cited

U.S. PATENT DOCUMENTS

| | | | |
|---|---|---|---|
| 4,108,330 | 8/1978 | Patterson | 220/269 X |
| 4,164,303 | 8/1979 | Waterbury | 220/359 |
| 4,167,234 | 9/1979 | Gordon et al. | 220/260 X |

*Primary Examiner*—George T. Hall

*Attorney, Agent, or Firm*—Charles E. Brown

[57] ABSTRACT

This disclosure relates to a pull tab for removing a removable panel portion of an easy opening container and thereafter effecting the folding up of the removed removable panel portion in an out-of-the-way position with respect to a resultant dispensing opening and with the removable panel portion being encased within the folded up tab. The tab is formed of plastics material which is so molded, preferably by an injection molding process, so as to have a memory in the form of a plurality of transversely extending memory fold lines. The memory fold lines are operable progressively to fold or roll up the tab in pup tent style to assume a triangular cross section. The removable panel portion is provided with transverse fold lines in alignment with the memory fold lines so as to be folded up together with and within the tab. The tab is permanently secured to the container panel.

15 Claims, 6 Drawing Figures

PULL TAB HAVING MEMORY FOR EFFECTING ROLLING UP OF TAB AND REMOVABLE PANEL PORTION

This invention relates in general to new and useful improvements in easy opening containers, and most specifically to a container wherein the pull tab and removable panel portion remain attached to the container after the opening thereof has been effected.

In the past the tab is either fixedly secured to the container panel and merely serves to break away and inwardly displace the displaceable panel portion, or the tab is fixedly secured to the removable panel portion and is removed from the container together with the removable panel portion. In some instances there has been proposed arrangements where the tab is permanently secured to the container panel in addition to its securement to the removable panel portion so that when the removable panel portion is displaced, it is retained with the container by the tab and is shifted to an out-of-the-way position. The net result is that the removable panel portion is still exposed to a certain extent and in many instances is retained in an awkward position.

In accordance with this invention there is provided a tab which has a memory which automatically acts upon the tearing out of a removable panel portion to effect rolling up of the tab to a substantially compact out-of-the-way position while remaining attached to the container panel.

It is also proposed in accordance with this invention to construct the removable panel portion so that when it is removed it will be also folded and rolled up with the tab to the out-of-the-way position.

Another feature of the invention is the construction of the tab so that when it and the removable panel portion roll up the removable panel portion is encased within the tab in a position where the raw edges thereof cannot be engaged by the user.

A tab formed in accordance with this invention has an anchoring portion, a securing portion and a grip portion with the grip portion normally overlying the securing portion and being removably interlocked therewith so as not accidentally to roll up permaturely. The removable panel portion underlies and is bonded to the securing portion. The removable panel portion is also provided with lines of weakness aligned with memory means of the securing portion so that when the removable panel portion is torn from the container panel it may automatically be folded by the memory means of the securing portion so as to be part of a folded arrangement disposed in an out-of-the-way position remote from the resultant dispensing opening.

In order that the grip portion may advantageously be utilized in effecting rupture and removal of the removable panel portion relative to the remainder of the container panel, fastening means secure a starting end of the removable panel portion both to the securing portion and the grip portion. The securing portion is additionally secured to the removable panel portion in substantially overall relation so as to assure folding of the removable panel portion with the securing portion as the removable panel portion is removed.

With the above and other objects in view that will hereinafter appear, the nature of the invention will be more clearly understood by reference to the following detailed description, the appended claims, and the several views illustrated in the accompanying drawings.

IN THE DRAWINGS

Figures 1, 2, 3, 4, 5, 6:
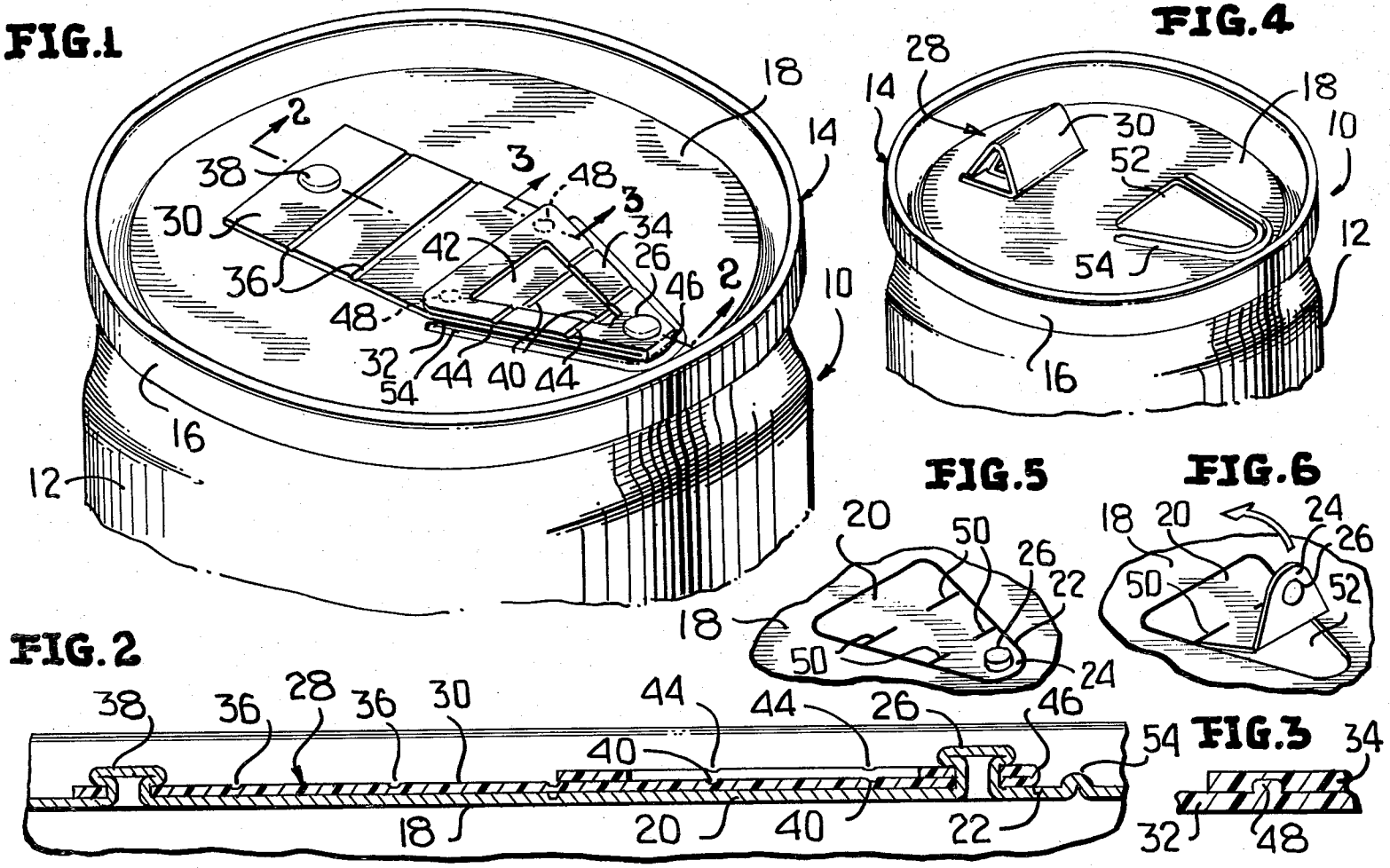
FIG. 1 is a top perspective view of a can wherein the end panel is provided with a removable panel portion and there is attached to both the end panel and the removable panel portion a tab formed in accordance with this invention.
FIG. 2 is an enlarged fragmentary vertical sectional view taken longitudinally of the tab along the line 2—2 of FIG. 1, and shows most specifically the mode of securement of the tab to the end panel and the removable panel portion.
FIG. 3 is an enlarged fragmentary vertical sectional view taken generally along the line 3—3 of FIG. 1, and shows the manner in which the grip portion of the tab is temporarily locked to the securing portion to prevent memory means of the grip portion from effecting a rolling up of the grip portion prematurely.
FIG. 4 is a top perspective view similar to FIG. 1, and shows the container in its opened position with the tab and the removable panel portion being rolled up in response to the action of the memory means of the tab.
FIG. 5 is a fragmentary schematic view showing the removable panel portion prior to the attachment of the tab thereto.
FIG. 6 is a schematic view similar to FIG. 5 and schematically shows how the removable panel portion is automatically folded by the tab as the opening process proceeds.

Referring now to the drawings in detail, it will be seen that there is illustrated in FIG. 1 an easy opening container formed in accordance with this invention, the container being generally identified by the numeral 10. The container 10 includes a conventional body 12 having at least the upper end thereof closed by a separately formed end unit generally identified by the numeral 14. The end unit 14 is secured to the body 12 by a conventional double seam 16 and includes an end panel 18. As is best shown in FIG. 5, the end panel 18 is provided with a removable panel portion 20 which is outlined by lines of weakness 22 preferably in the form of scoring. The removable panel portion 20 is illustrated as being of a generally triangular configuration, but may assume other shapes. It does, however, have a starting end 24 which is preferably provided with an integral rivet 26.

This invention particularly relates to the provision of a tab for effecting first the removal of the removable panel portion 20 and then the folding and concealing of the removed removable panel portion in an out-of-the-way position while still retained on the container. The tab formed in accordance with this invention is generally identified by the numeral 28 and is preferably formed of a plastics material which is injection molded so as to have a memory. The tab 28 is formed with three portions, an anchoring portion 30, a securing portion 32, and a grip portion 34.

The anchoring portion 30 is preferably rectangular in outline for reasons to be described hereinafter and extends to that edge of the removable panel portion 20 disposed remote from the starting end 24. The anchoring portion 30 is divided into a plurality of panels by transversely extending memory fold lines 36. The panel of the anchoring portion 30 disposed remote from the removable panel portion 20 is permanently secured to the end panel 18 by a suitable fastener 38 which is preferably in the form of an integral rivet.

The securing portion 32 is generally triangular in outline and is joined integrally with the anchoring portion 30 along the memory fold lines 36. The outline of the securing portion 32 generally corresponds to that of the line of weakness 22 although it has a square cut remote end as opposed to the rounded starting part of the line of weakness. The securing portion 32 is also provided with a plurality of memory fold lines 40 which extend transversely of the securing portion and are spaced in accordance with the spacing of the memory fold lines 36 for a reason to be described hereinafter.

The grip portion 34 has the same generally triangular outline as the securing portion 32, but is provided with a circular opening 42 for receiving one's fingers to effect a gripping thereof. The grip portion 34 is also provided with memory fold lines 44 which are aligned with the memory fold lines 40.

The forward end of the grip portion 34 is integrally connected to the forward end of the securing portion 32 by a reverse bend 46. The rear corner parts of the grip portion 34 are releasably secured to the underlying parts of the securing portions 32 by molded-in snaps 48 as is best shown in FIGS. 1 and 3. The molded-in snaps 48 prevent the premature folding of the grip portion 34.

The rivet or like fastening means 26 of the removable panel portion 20 extends through and secures the front end parts of the securing portions 32 and the grip portion 34 to the front end 24 of the removable panel portion 20 with the already aligned memory fold lines 40 and 44 being aligned with the transverse lines of weakness 50 formed in the removable panel portion 20. These transverse lines of weakness are illustrated as being in the form of scores which extend only partially across the removable panel portion 20, leaving central parts which are not subject to weakening.

Further, the underside of the securing portion 32 is suitably bonded to the upper surface of the removable panel portion 20. Normally, the end panel 18 will have a plastic coating to which the plastic pull tab 28 may be heat sealed. If not, a suitable adhesive (not shown) may be utilized.

OPERATION

When it is desired to open the container 10, the rear part of the grip portion 34 is lifted with the hold-down snaps 48 being disengaged. An upward pull is then exerted on the rivet 26 or other fastening means so as to effect rupture of the end panel 18 along the lines of weakness 22 at the starting end 24 of the removable panel portion 20. Once rupture is initiated, the grip portion is pulled rearwardly so as to tear out the removable panel portion in the manner generally shown in FIG. 6 to effect the definition of a dispensing opening 52 in the end panel 18 as shown in FIG. 4. If desired, the end panel 18 may be provided with a protecting bead 54 adjacent to the opening 52.

Once the removable panel portion 20 has been fully torn from the end panel 18 and the grip portion 34 has been released, the memory fold lines 40 and 44 become effective to effect a rolling up or folding of not only the grip portion 34 and the securing portion 32 but also the removed removable panel portion 20 along the lines of weakness 50 into a generally triangular cross sectional tube or pup tent arrangement. Further, the memory fold lines 36 are operative to effect a continuous folding up of the tab 28 so that the removable panel portion 20 which was disposed outermost of the folded up grip portion 34 and the securing portion 32 will be encaged within the folded up anchoring portion 30 as is best shown in FIG. 4. Since the anchoring portion 30 is rectangular in outline and the removable panel portion 20 is triangular in outline, it will be seen that there will be a full encasement of the removable panel portion 20 so that there will be no exposed raw edges.

The anchoring portion 30 being permanently attached to the end panel 18 by the fastener 38, serves to hold the folded up tab 28 and the removed removable panel portion 20 in an out-of-the-way position spaced from the dispensing opening 52.

Although only a preferred embodiment of the invention has been specifically illustrated and described herein, it is to be understood that minor variations may be made in the tab construction without departing from the spirit and scope of the invention as defined in the appended claims.

I claim:

1. A pull tab for easy opening containers, said pull tab comprising an anchoring portion, an intermediate securing portion and a grip portion, and linear memory means extending transversely of said pull tab in said securing portion for effecting automatic folding of said securing portion to a folded out-of-the-way position when released.

2. A pull tab according to claim 1 wherein said grip portion also has memory means for effecting folding of said grip portion when said grip portion is released.

3. A pull tab according to claim 2 wherein said memory means of said grip portion are aligned with said memory means of said securing portion for effecting folding of said grip portion within said receiving portion.

4. A pull tab according to claim 2 together with means releasably securing said grip portion to said securing portion normally to prevent separate folding of said grip portion.

5. A pull tab according to claim 3 wherein said anchoring portion also has memory means for folding said anchoring portion about said securing portion.

6. A pull tab according to claim 1 wherein said anchoring portion also has memory means for folding said anchoring portion about said securing portion.

7. A pull tab according to claim 1 wherein said tab is secured to an easy opening container panel including a removable panel portion, said securing portion overlies and is secured to said removable panel portion, and said removable panel portion has lines of weakness aligned with said securing portion memory means for folding of said removable panel portion when removed by and together with said securing portion.

8. A pull tab according to claim 7 wherein said removable panel portion is integrally formed with said easy opening container panel and is defined by a line of weakness.

9. A pull tab according to claim 7 wherein said removable panel portion has a starting end, and fastener means permanently secure said securing portion and said grip portion to said removable panel portion starting end.

10. A pull tab according to claim 9 wherein other fastener means permanently secure said anchoring portion to said easy opening container panel remote from said removable panel portion starting end.

11. A pull tab according to claim 9 wherein said securing panel is further overall bonded to said removable panel portion.

12. A pull tab according to claim 9 wherein said grip portion also has memory means for effecting folding of said grip portion when said grip portion is released.

13. A pull tab according to claim 12 together with means releasably securing said grip portion to said securing portion normally to prevent separate folding of said grip portion.

14. A pull tab according to claim 12 wherein said memory means of said grip portion are aligned with said memory means of said securing portion and said removable panel portion lines of weakness for effecting folding of said grip portion within said securing portion and said removable panel portion.

15. A pull tab according to claim 14 wherein said anchoring portion also has memory means for folding said anchoring portion about said securing portion.

* * * * *